United States Patent [19]

Staat et al.

[11] 4,313,325

[45] Feb. 2, 1982

[54] PUSH BENCHES

[75] Inventors: Karl-Hans Staat, Homberg; Theodor Zacharias, Meerbusch, both of Fed. Rep. of Germany

[73] Assignee: Kocks Technik GmbH & Co., Dusseldorf, Fed. Rep. of Germany

[21] Appl. No.: 83,775

[22] Filed: Oct. 11, 1979

[30] Foreign Application Priority Data

Nov. 11, 1978 [DE] Fed. Rep. of Germany ..... 2848990

[51] Int. Cl.[3] ..... B21B 17/04

[52] U.S. Cl. ..... 72/208; 72/224; 72/370

[58] Field of Search ..... 72/208, 224, 234, 235, 72/237, 96, 209, 244, 248, 35

[56] References Cited

U.S. PATENT DOCUMENTS 1,782,968 11/1930 Keller ..... 72/224

3,348,403 10/1967 Bartley ..... 72/237

FOREIGN PATENT DOCUMENTS 287886 5/1969 U.S.S.R. ..... 72/224

*Primary Examiner*—Milton S. Mehr

*Attorney, Agent, or Firm*—Buell, Blenko, Ziesenheim & Beck

[57] ABSTRACT

A push bench is provided for the production of tube blooms in which the last roll stands of a plurality of roll stands one behind the other in the direction of pushing have radially adjustably supported rolls, said radially adjustably supported rolls being radially adjustable at the beginning of each working cycle with regard to the diameter or diameter tolerance of the mandrel rod being used for that work cycle.

5 Claims, 3 Drawing Figures

PUSH BENCHES

This invention relates to push benches for the production of tube blooms and particularly to a push bench for the production of tube blooms having a number of roll stands arranged one behind the other in the direction of pushing, of which at least the last ones participating in reduction of the tube bloom have radially adjustable supported rolls.

Push benches will rolls adjustably supported in the rolls stands are known which permit initial radial adjustment of the rolls at the time they are installed in the line, but this prior art adjustment possibility serves only as a means to compensate for roll wear if the rolls have to be reworked due to wear phenomena between runs or where there are diameter variations in the tube blooms between runs. In this prior art form of construction the rolls are not adjusted during operation.

A roll spacing from the longitudinal axis of the tube bloom that remains constant during operation, as in the prior art, has the disadvantage that tube blooms with different wall thicknesses result if the mandrel rods used do not have precisely the same outside diameters. Nevertheless, the latter is relatively frequently the case if hot-rolled mandrel rods without mechanical reworking or used mandrel rods rendered reusable by straightening are used. This becomes particularly clear when one considers that a large number of rods more than 20 meters long and having a diameter of, e.g., 120–150 millimeters and prepared from high-grade steel should have tolerances of one tenth of a millimeter in order to maintain the wall thickness difference in the tube blooms as small as possible. In order to reduce the costs, it has already been proposed to sort out rods with the same or approximately the same diameters and use them in common lots, but this means that considerably more mandrel rods than are actually needed must be procured and be held available. Such a method is uneconomical due to the investment and storage costs as well as those of sorting.

The present invention provides a push bench structure that is not fraught with the above shortcomings and in which mandrel rods whose admissible diameter tolerance is about ±0.5 mm and in which the wall thicknesses of the tube blooms still remain essentially the same can also be used. This, of course, provides substantial economies over prior art designs and practices, not only in producing more uniform product but also in reducing the necessary inventory of mandrel rods and the labor or sorting and cataloging them.

This is achieved in accordance with the invention in that the radially adjustable rolls are radially adjustable prior to the beginning of each working cycle with regard to the diameter or diameter tolerance of the mandrel rod used. The adjustment can be carried out here in such a manner that the desired wall thickness of the tube bloom results.

Of course, the result of this is that the outside diameters of the tube blooms are different, which however need not be considered a disadvantage because the tube blooms are in any case reprocessed, e.g., on a stretch-reducing rolling mill, and only then acquire final outside diameter. Diameter differences of the magnitudes contemplated here can be readily compensated to the desired final diameter in a reprocessing, e.g., in a stretch-reducing rolling mill, without requiring additional expense. In contrast, tube blooms with different wall thicknesses, such as are common in prior art practices, are a considerably greater nuisance because the differences in wall thickness can only be compensated with a stretch-reducing rolling mill by first measuring the difference in wall thickness as for example in accordance with German Pat. No. 1,427,922 and correcting the degree of stretching by continuously varying the r.p.m.'s in accordance with the differences in wall thickness. However, this is possible only within the physically specified limits of the stretch-reducing rolling mill, all the more so since the additional wall thickness deviations over the length of a tube bloom are to be compensated. Thus, by using the present invention, even mandrel rods that deviate quite widely from the ideal measurement can be used, by which the operating costs for the mandrel rods can be kept economically low.

Although it would be possible in principle, it is not necessary to equip all the roll stands with rolls that are radially adjustable prior to the beginning of each working cycle. It is generally sufficient to equip only the last roll stands in the direction of pushing, e.g., two or three, that participate in the reduction of the tube bloom, in the manner according to the invention.

In a preferred implementation of the invention, the adjustable rolls are adjustable by means of a servo motor located on the roll stand involved. Such a servo motor facilitates a rapid and precise adjustment of all adjustable roll passes simultaneously and substantially facilitates the work of the attendant personnel. It is recommended here to control the servo motor or motors with a computer, which obtains the mandrel rod diameter from an automatic measuring arrangement or from manual indication. In this manner, an essentially automatic adjustment of the adjustable roll stands is possible, by which erroneous adjustments and thus rejects are avoided and a high production capacity is facilitated with a rapid pushing sequence.

The invention is exemplified in the drawing on the basis of an implementation example.

Figure 1:
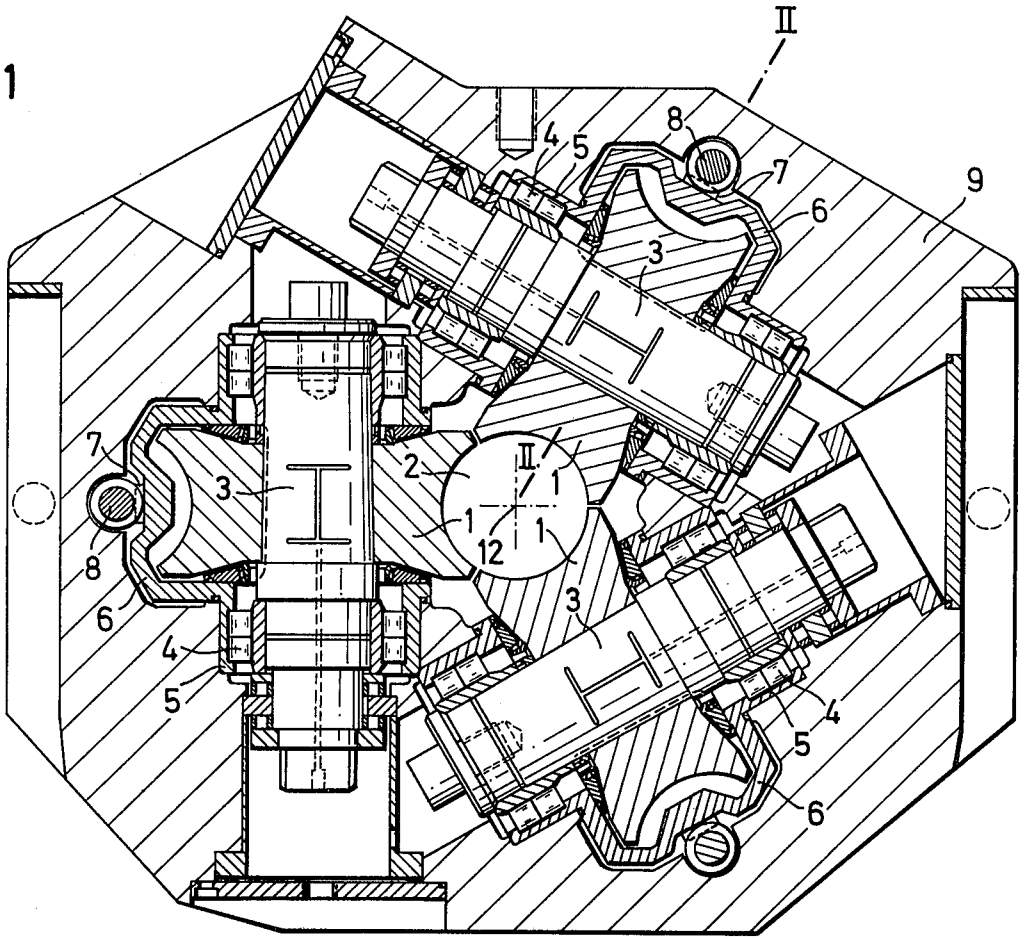
FIG. 1 shows a roll stand of a push bench in cross section.

In FIG. 1 three rolls (designated by 1) are displaced by 120° in the form of a star in the peripheral direction and form a pass opening 2 for the tube blooms or mandrel rods (not shown). The rolls 1 are supported on roll shafts 3, which in turn are supported in special roller bearings 4. The bearing support is designed such that the rolls 1, together with the roll shafts 3, can be displaced in the axial direction by a restricted amount. The roller bearings 4 are specially prepared in the sense that their outer rings 5 have outer surfaces that are eccentric to their inner sliding surfaces and form a part of a bearing carrier 6 which is rotatable coaxially around roll shafts 3 and rolls 1 in opening in roll stand housing 9. In short, the outer rings 5 are each components of sleeve-like bearing pieces 6 in the form of a segment of a circle that are provided with gear teeth 7 on their outer periphery engaged and driven by a worm shaft 8.

A rotary movement of the worm shaft 8 induces a corresponding rotation or swivelling of the bearing housing 6 about the axis of the rolls 1 and thus the eccentric outer ring 5 is rotated inside the roll stand housing 9. As a result of this, the rolls 1 are shifted in the radial direction by a limited amount corresponding to the variation in thickness of the outer rings 5. The self-locking design of the worm 8 prevents an uncontemplated deviation of rolls 1 in the radial direction during the pushing process.

Figure 2:
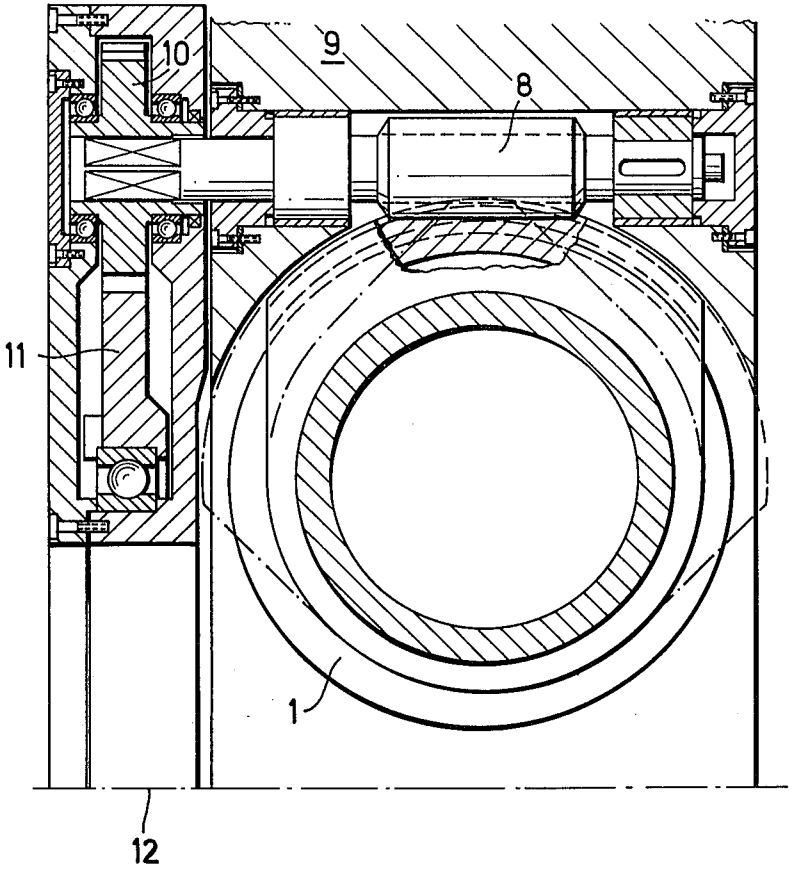
FIG. 2 shows a section along line II—II of FIG. 1.

The worm 8 and its bearing support in the roll stand housing 9 can be seen in FIG. 2. The worm is driven by a bevel gear 10, which is solidly connected with the worm 8. The bevel gear 10 engages in a ring gear 11 that is supported concentrically to the thrust axis 12. All three worms 8 are coupled together through the ring gear 11 and can thus shift the rolls 1 concentrically in common to the thrust axis 12 toward or away from the latter.

Figure 3:
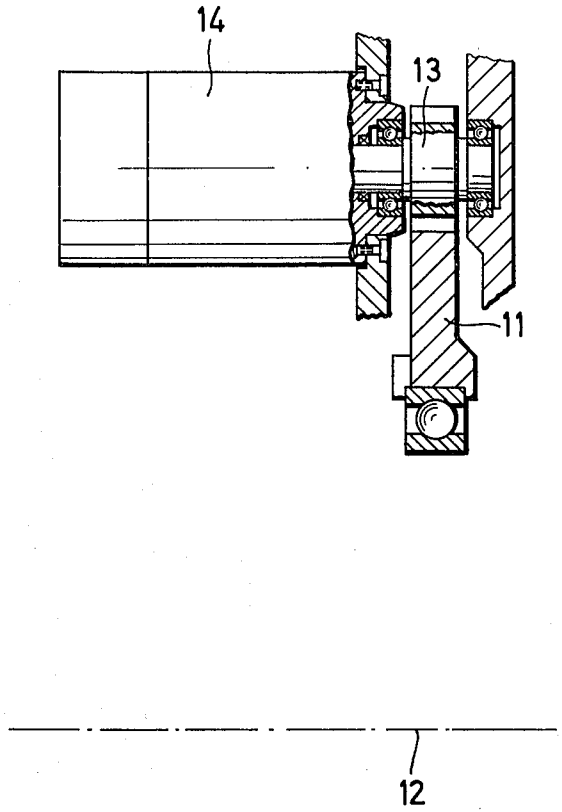
FIG. 3 shows a partial section according to FIG. 2, but displaced by about 30° in the peripheral direction of the roll stand.

FIG. 3 shows the manner in which the ring gear 11 is driven. A drive bevel gear 13 of a servo motor 14 engages in the ring gear 11. The servo motor 14 can be expediently designed as a hydromotor with step adjustment, such that the rolls 1 are adjustable in common by the desired amount in the radial direction by the servo motor 14 over the drive gear 13, the ring gear 11, the bevel gear 10, and the worm 8. The servo motor 14 is controlled in a familiar manner here by a computer that is not shown.

In the foregoing specification we have set out certain preferred practices and embodiments of our invention, however it will be understood that this invention may otherwise be embodied within the scope of the following claims.

We claim:

1. A push bench for the production of tube blooms having a plurality of roll stands arranged one behind the other in the direction of pushing, of which at least the last said roll stands participating in reduction of the tube bloom have radially adjustably supported rolls, each said roll stand having radially adjustably supported rolls comprising a roll housing, a plurality of rolls in said housing surrounding a pass line, a mandrel rod for insertion centrally of said pass line and means in said housing moving each of said plurality of rolls radially relatively to a mandrel rod each time a mandrel is inserted in the pass in accordance with measurements of said mandrel diameter made prior to insertion whereby said rolls are maintained at a preselected radial distance from the periphery of said mandrel rod.

2. A push bench as claimed in claim 1 wherein said means for radially moving said rolls include bearings carrying said rolls and eccentric bearing housings carrying said bearings which on rotation around the roll axis move the bearings radially relatively to the pass line.

3. A push bench as claimed in claim 2 wherein the eccentric bearing housings include gear segment means on said housings, and worm drive means drivingly engaging said gear segment for rotation of said bearing housing around the axis of the roll.

4. A push bench as claimed in claim 1, 2 or 3 wherein said means moving the rolls include a servo drive motor on said roll stand having radially adjustably supported rolls.

5. A push bench as claimed in claim 4 wherein each said servo motor is controlled by a means which drives said servo motor in accordance with the mandrel rod diameter inserted in the pass opening.

* * * * *

UNITED STATES PATENT AND TRADEMARK OFFICE

CERTIFICATE OF CORRECTION

PATENT NO. : 4,313,325

DATED : February 2, 1982

INVENTOR(S) : KARL-HANS STAAT and THEODOR ZACHARIAS

It is certified that error appears in the above-identified patent and that said Letters Patent are hereby corrected as shown below:

Column 1, line 11, "will" should read --with--.

Signed and Sealed this

*Twenty-second* Day of *June 1982*

[SEAL]

*Attest:*

GERALD J. MOSSINGHOFF

*Attesting Officer*

*Commissioner of Patents and Trademarks*